US005427231A

United States Patent [19]

Willimann

[11] Patent Number: 5,427,231

[45] Date of Patent: Jun. 27, 1995

[54] ORGANIZER FOR PERSONAL ACCESSORIES

[76] Inventor: Charles S. Willimann, 19823 Edensborough Dr., Katy, Tex. 77449

[21] Appl. No.: 297,149

[22] Filed: Aug. 30, 1994

[51] Int. Cl.[6] ..... A47F 7/02; A47F 7/03; A47F 5/08; A61B 19/02

[52] U.S. Cl. ..... 206/38; 206/235; 206/574; 312/209; 312/244; 211/59.1; 211/70.6; 211/87; 211/88; 220/345

[58] Field of Search ..... 206/38, 235, 574; 312/209, 244; 211/59.1, 70.6, 87, 88; 220/345

[56] References Cited

U.S. PATENT DOCUMENTS

| | | | |
|---|---|---|---|
| 16,509 | 8/1857 | Burleholder | 206/574 |
| 242,319 | 5/1881 | Hershey | 217/62 |
| 489,593 | 1/1893 | Ramer | 211/59.1 |
| 1,020,539 | 3/1912 | Cowles | 217/62 |
| 2,730,243 | 9/1948 | Platt | 211/59.1 |
| 3,363,775 | 12/1965 | Shaw | 211/70.6 |
| 4,111,341 | 9/1978 | Carrozo | 206/574 |

*Primary Examiner*—Jimmy G. Foster
*Assistant Examiner*—Tara Laster

[57] ABSTRACT

An organizer (20, 60, 90) for personal accessories which is mountable on a wall and comprises a container box (21, 61, 93) with structural members (29, 30, 69, 70) configured to provide shelves and trays and having a plurality of item retention devices including screw hooks (50–52, 75, 76) and pockets (55, 83, 97) which are affixed thereto for accommodating the assembly, storage and retention of personal accessories in a single convenient location.

18 Claims, 8 Drawing Sheets

ORGANIZER FOR PERSONAL ACCESSORIES

FIELD OF THE INVENTION

This invention relates to organizers and more particularly to an organizer for personal accessories which is mountable on a wall, such as the wall of a closet, and is adapted for the storage and retention of a variety of accessories.

BACKGROUND OF THE INVENTION

For the storage of personal items, it is usually necessary to employ a number and variety of devices, most of which are specifically designed to accommodate a specific personal item. Included in this category are such devices as jewelry boxes, necktie racks, and receptacles for specific items such as coins, collar stays, business cards, keyrings, shoe horns and the like. Because of their various and unique designs and purposes most such contemporary devices are incompatible for location in a single place. Some are intended for placement in a drawer or on a counter top, others such as a necktie rack, for location in a closet or a dressing room.

SUMMARY OF THE INVENTION

The invention is an organizer for personal accessories which is mountable on a wall structure such as a closet wall, and is adapted for the storage and retention of personal accessories. The organizer comprises a container box having two side wall members, front wall and back wall members, and top and bottom members which are slidably and removably mounted on the container box. The top and bottom members are each slidably mounted for movement between a first position which closes the box and a second position which opens the box. A screw hook with a threaded shank through a side wall of the container box is adapted to be screwed into an end edge of the top member when in its closed position to thereby lock the top member in the closed position. A similar screw hook in the front wall of the box is adapted to be screwed into an edge of the bottom member when in its closed position to thereby lock the bottom member in the closed position. Both screw hooks are retractable to release the top and bottom members. A pocket means of flexible material fixed to at least one of the wall members of the container box provides a pocket for receiving miscellaneous accessories. In addition, a plurality of screw hooks fixed to the exterior of the container box and its top and bottom members in a selective spacing provide hooks from which a variety of accessories may be suspended. Screw hooks in the ends of the top and bottom members provide handle means for effecting sliding movement.

In a modified form of the organizer designed for storage of a tailor's accessories, one side wall of the container box is provided with an elongate slot with a length sufficient to accommodate back and forth movement of a tailor's chalk when placed therein. A chalk sharpener blade is mounted in the container box with its blade edge extending into the slot whereby a tailor's chalk can be sharpened by back and forth movement of the chalk when placed in the slot. A lining of elastic material along the inner edges of the slot provides a chalk dust retention means. In addition, a pin cushion is fixed to the top surface of the top member and the top and bottom members are each provided with an extension having handle means provided thereon and suitable for use as a shelf or tray, the extensions being of substantially equal length and extending from opposite sides of the box.

DETAILED DESCRIPTION OF THE INVENTION

Figure 1:
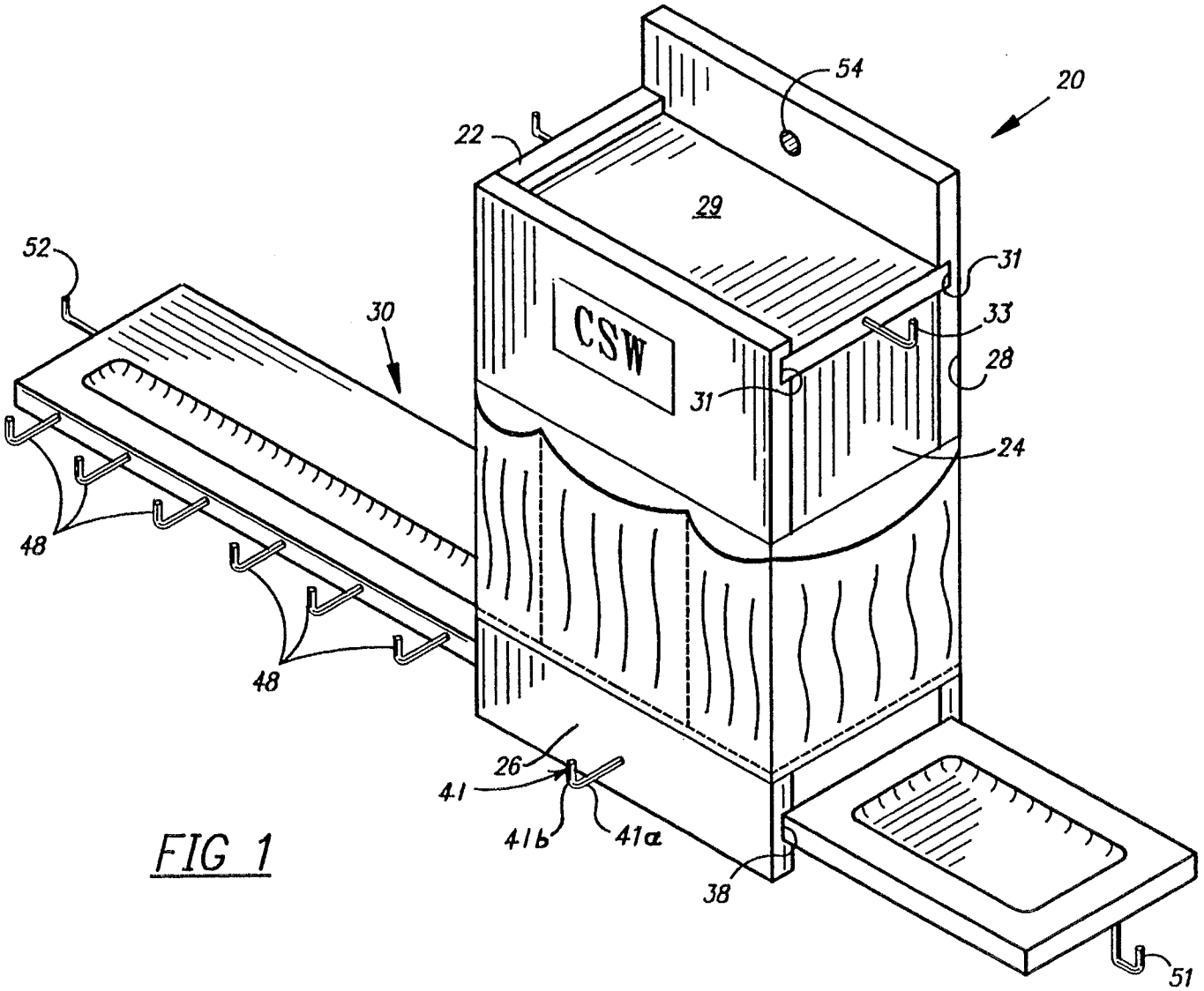
FIG. 1 is a perspective view of a preferred embodiment of an organizer for personal accessories constructed in accordance with the invention.

Referring more particularly to the drawings, there is shown in FIG. 1, an organizer 20 which represents a preferred embodiment of the invention. The organizer 20 includes a container box constructed with side wall members 22 and 24, a front wall member 26, a back wall member 28 and top and bottom members 29 and 30, respectively. The container box is of rectangular shape and cross section and the wall members thereof are preferably attached to one another by brass nails for decorative purposes.

The top member 29 of the box is adapted for sliding movement thereon. For this purpose, the inner surfaces of the members 26, 28 which face towards one another, are each provided with an elongate groove 31 near its top edge. The grooves 31, extend horizontally in parallel relation from corresponding edges 26*a*, 28*a* of the front wall and back wall members. Each of the grooves 31 opens at the edge of the wall member in which it is formed just above the top edge of the side wall member 24 and extends to the side wall 22. The grooves together are adapted to receive the opposite edge portions of the top member 29.

The top member 29 is slidably moveable in the grooves 31 to a position which completely closes the container box, as shown in FIG. 1, or which leaves it partially open. It may also be removed completely from the box. To facilitate movement, the top member 29 is provided with a handle in the form of a screw hook 33. The screw hook 33 has a shank portion 33*a* threaded into an end edge 34 of the member 29 and a hook portion 33*b* extending perpendicularly to the shank and oriented such that the screw hook 33 can serve as a hook from which a personal accessory may be suspended.

Another screw hook 36 similar to screw hook 33 serves as a means for locking the top member 29. The screw hook 36, which is provided with a threaded shank portion 36*a* and hook portion 36*b*, is mounted on the side member 22 in a location such that it is adapted to be screwed with axial movement of the shank through the side member 22 into an edge of the top member 29 when the top member is in the closed position, thereby locking the top member 29 in the closed position. The screw hook 36 is also oriented with its hook portion extending upwardly. To release the top member 29, the screw hook 36 may be retracted by unscrewing.

Figure 4:
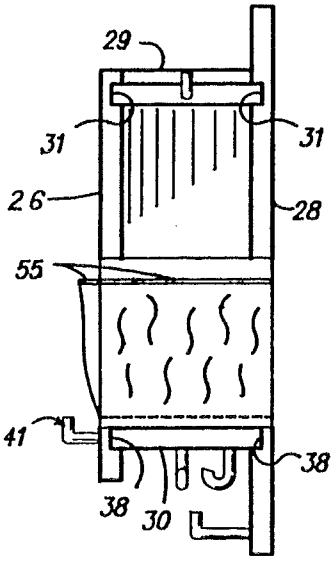
FIG. 4 is a side view of the organizer in FIG. 1.
Figure 3:
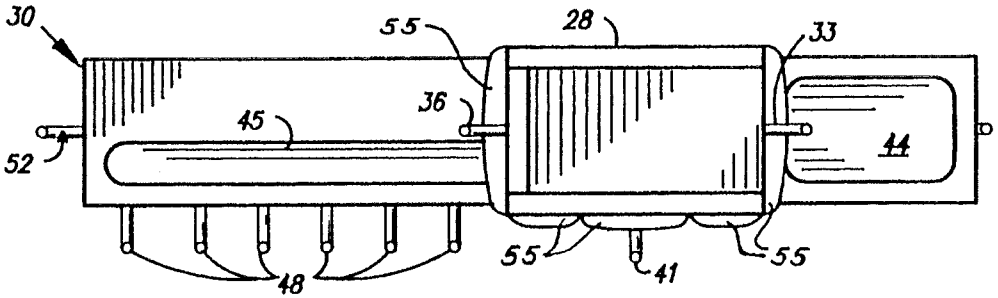
FIG. 3 is a top view of the organizer in FIG. 1.
Figure 5:
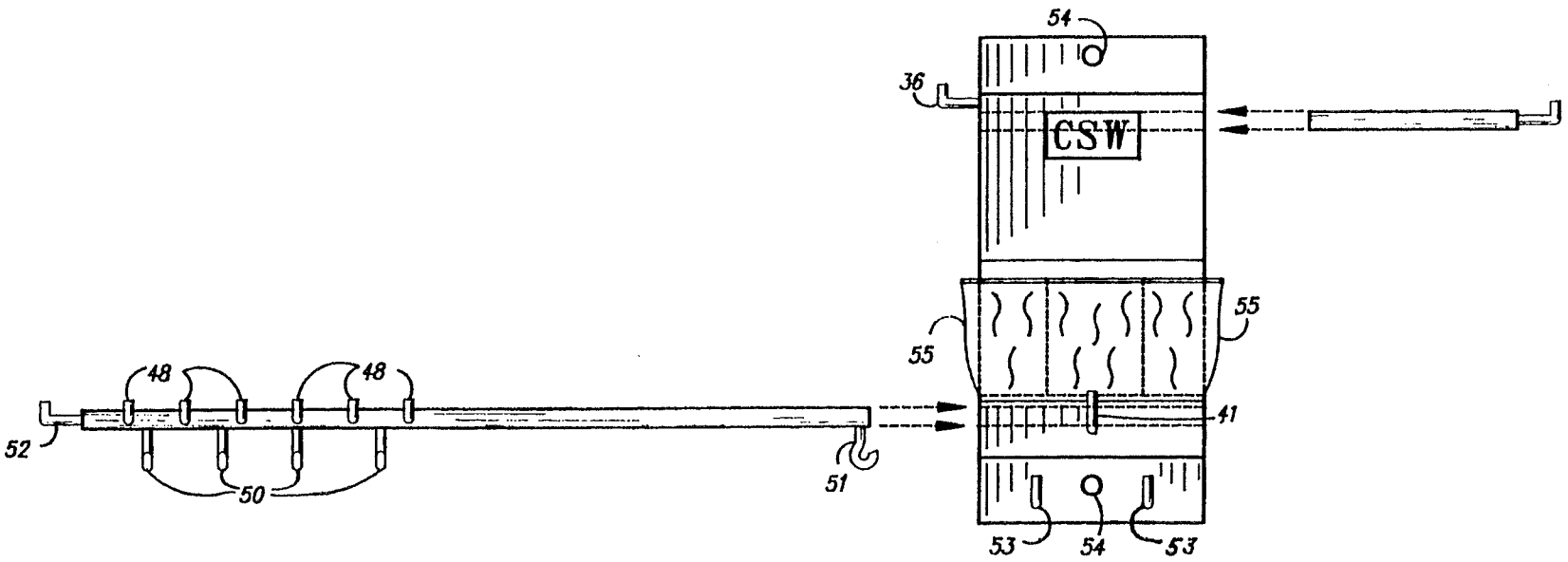
FIG. 5 is a front, partially exploded view of the organizer of FIG. 1, wherein the top and bottom members of the container box of the organizer have been slidably removed therefrom.
Figure 6:
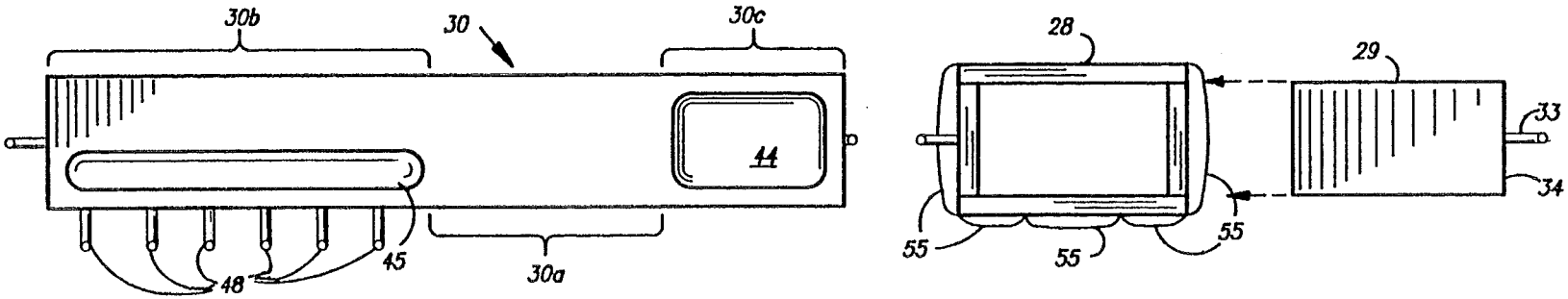
FIG. 6 is a top view of the organizer shown in FIG. 5.
Figure 8:
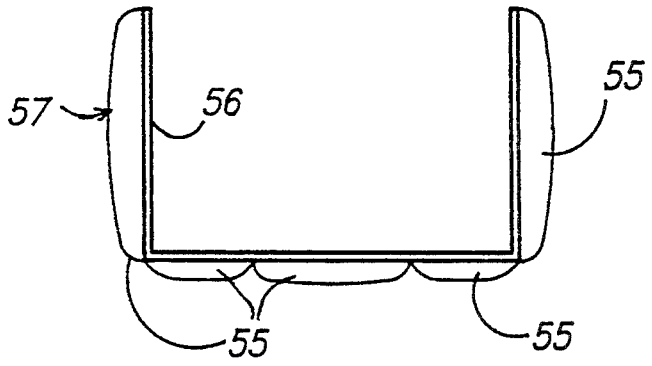
FIG. 8 is a top view of the sheets of flexible material in FIG. 7 showing their attachment locations to one another to provide a plurality of pockets which are secured to the sides and front of the container box of the organizer.
Figure 7:
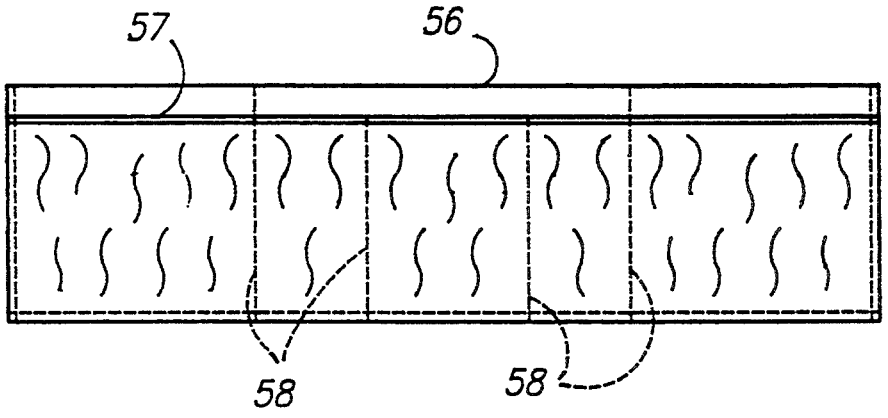
FIG. 7 is a plain view of two sheets of flexible material which are bonded to the exterior wall members of the container box of the organizer of FIG. 1 to provide pocket means for receiving personal accessories.

The bottom member 30 of the container box is also adapted for sliding movement on the box 21. For this purpose, the inner surfaces of the front and back wall members 26, 28 are each provided with a second elongate groove 38, as shown in FIG. 4 which extends horizontally thereacross and opens at each side edge thereof just below the side wall members 22, 24. The grooves 38 receive the front edge and rear edge portions of the bottom member 30 which, as best seen in FIGS. 5 and 6, is provided with a central portion 30*a* of a size and configuration which completely closes the bottom of the container box when positioned directly beneath the side wall members 22, 24. The bottom 30 is also provided with end portions 30*b*, 30*c* which extend beyond the sides of the box 21 when in its box closing position. The end portion 30*b* is of greater length than the end portion 30*c* and is particularly useful as a shelf.

The organizer 20 is also provided with a means for locking the bottom member 30 in its closed position. For this purpose, it is provided with a screw hook 41 having a threaded shank 41*a* and a hook portion 41*b* which extends perpendicularly therefrom. The shank portion 41*a* is threaded into the front member 26 near the bottom end thereof which accommodates the slidable bottom member 30. The screw hook 41 is adapted to be screwed with axial movement of its shank through the front member 26 into the front edge 30*d* of the bottom member 30 and thereby lock the bottom member 30 when in its box closing position. The hook portion 41*b* is oriented upward so that the screw hook 41 is adapted to serve as a hook from which to suspend a personal accessory. It is also retractable by unscrewing to release the bottom member 30 which can be removed from the box if desired.

The end portion 30*c* of bottom member 30 has a top surface which is formed with a depression 44 of relatively shallow depth and with a flat bottom so as to be suitable as a coin collection tray. A similar but narrower and longer depression 45 is formed in the top surface of the end portion 30*b* of the bottom member 30 and thereby provides a tray as well as a retaining wall for the bottom edge of an item, such as a book which may be supported edge-wise on the end portion 30*b*.

It is also to be noted that a plurality of screw hooks 48, similar to the screw hooks 33 and 36, are fastened in uniformly spaced array to the front edge of end portion 30*b* of the bottom member 30. The screw hooks 48 are oriented such that each is adapted to serve as a hook from which a personal accessory may be suspended.

A second plurality of screw hooks 50, each having a threaded shank and a curved hook are attached in uniformly spaced array to the underside of end portion 30*b* of bottom member 30 as shown in FIG. 5. A single screw hook 51 with threaded shank and curved hook is fastened to the underside of the bottom member 30 near the end edge of the end portion 50*c*. A screw hook 52 with a straight hook portion 52*b* formed by a right angle bend with the shank 52*a* is threaded in the left end edge of the bottom member 30. All of the hooks 50, 51, 52 are oriented with their hooks adapted to support an accessory item which may be suspended therefrom.

Figure 2:
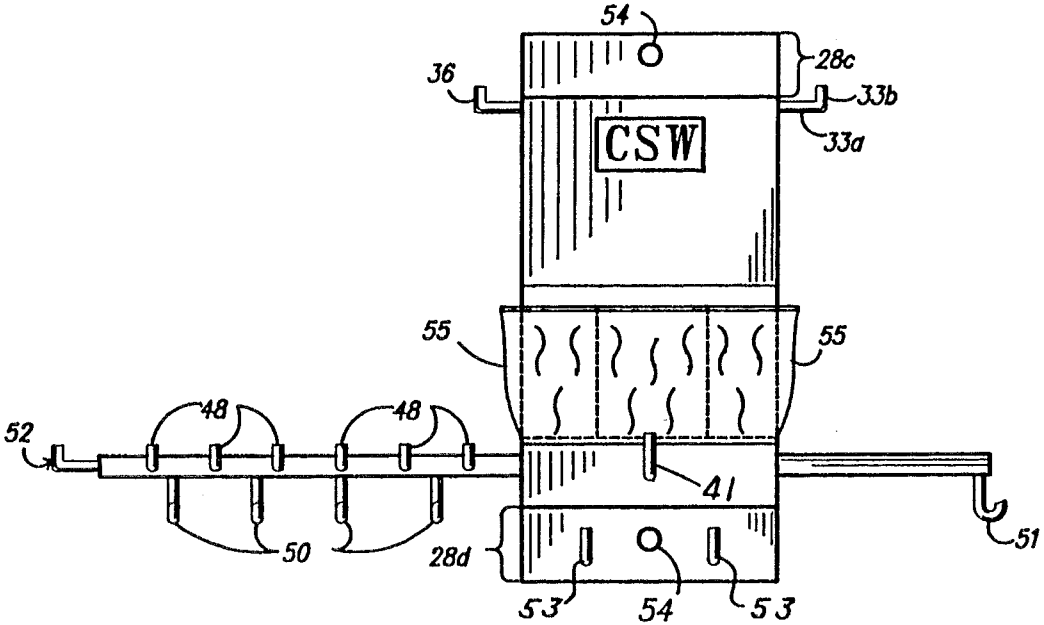
FIG. 2 is a front view of the organizer in FIG. 1.

The organizer 20 is particularly intended for mounting on the wall of a closet and for this purpose the back wall member 28 is made longer then the front 26, being provided with a top extension 28*c* and a bottom extension 28*d*, which project beyond the top and bottom members 29, 30 and also beyond the top and bottom edges of the front member 26. To facilitate attachment of the organizer 20 to a wall structure, each of the extensions 28*c*, 28*d* is provided with a hole 54 located along its centerline through each of which a fastener nail or screw may be inserted. Also, on the bottom extension 28*d*, a pair of screw hooks 53 are symmetrically located on opposite sides of the hole 54 as shown in FIG. 2.

It will also be seen that a plurality of pockets 55 are provided on the exterior of the container box on each of the wall members 22, 24 and the front member 26. The pockets are preferably of a flexible material such as a textile material or leather and may be formed from a pair of rectangular sheets 56, 57. One of the sheets 56 is bonded flush to the wall members 22, 24, 26 and the other sheet 57 is sewn to the sheet 56 along its bottom edge and its end edges. It is also sewn along a plurality of vertical lines 58 so as to provide a plurality of pockets 55 which are particularly suited for storing small personal accessories, such as collar stays, business cards and the like.

It is preferred that the various wall members which make up the container box, including the top and bottom members, be of wood such as oak, fir, cedar, cherry or mahogany. It is also preferred that the screw hooks which are fastened to the exterior surfaces of the organizer 20 be of brass as also the nails which couple the container walls to one another. In addition, it is generally desirable that a brass name plate, which may be appropriately engraved, be bonded on the front of the organizer on the front member 26.

It is therefore to be seen that a unique organizer is disclosed herein which is particularly suited for the storage of a variety of personal accessories, all at one location rather than at a number of different places. It is also adapted for mounting on a wall, such particularly as a closet wall and in instances where one might have no need for a container box, the organizer can be constructed with permanently fixed top and bottom members.

Figure 9:
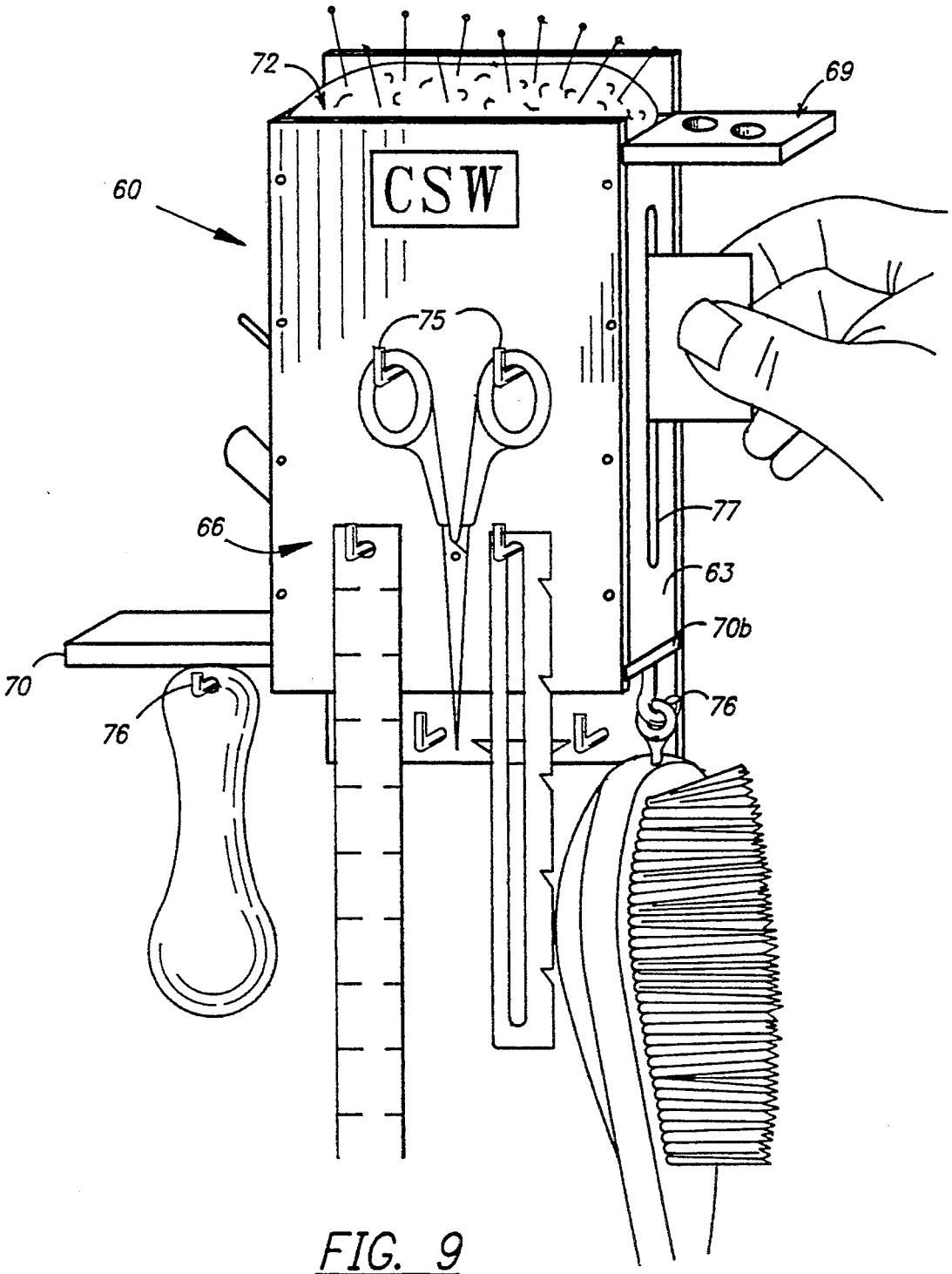
FIG. 9 is a perspective view of a modified form of the organizer of the invention which is specifically adapted for the storage and retention of a tailor's accessories.
Figure 12:
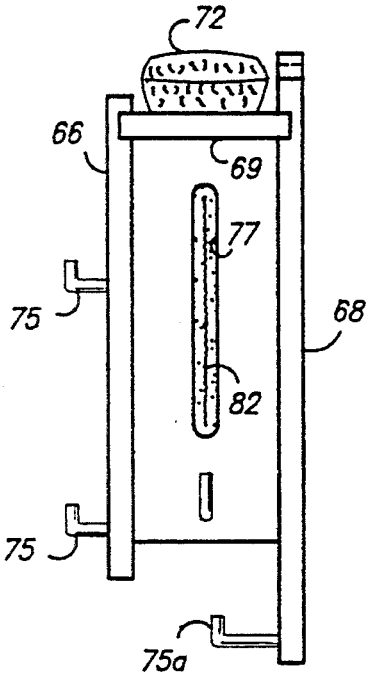
FIG. 12 is a right side view of the organizer of FIG. 9.
Figure 13:
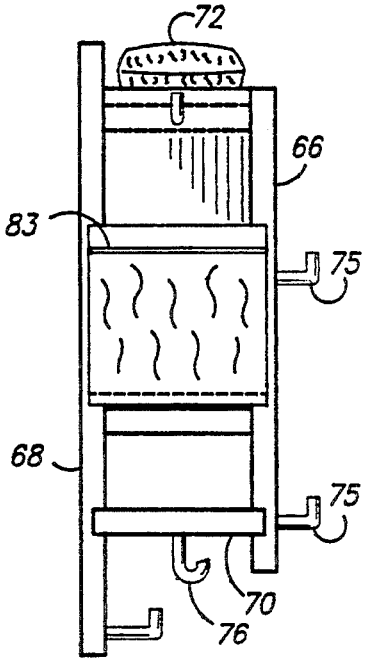
FIG. 13 is a left side view of the organizer of FIG. 9.
Figure 10:
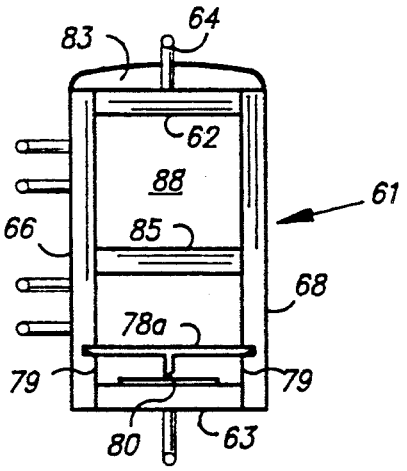
FIG. 10 is a top view of the container box of the organizer of FIG. 9 and wherein the top and bottom members of the box have been removed to show details.
Figure 11:
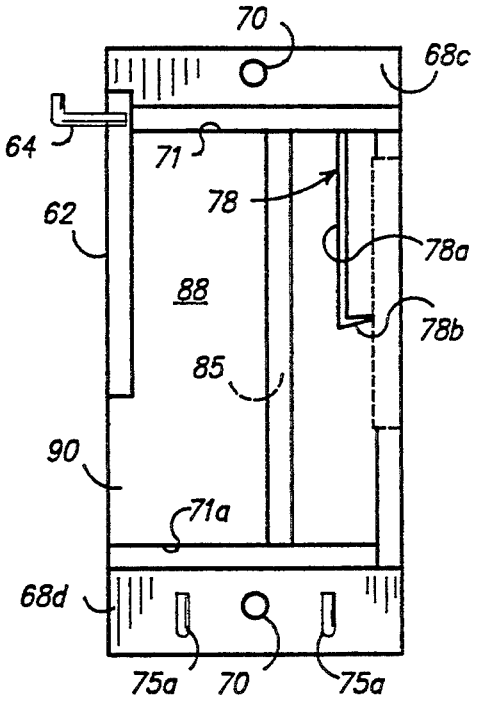
FIG. 11 is a front view of the container box of the organizer of FIG. 9 where the front wall and top and bottom members of the box have been removed to show details.
Figure 15:
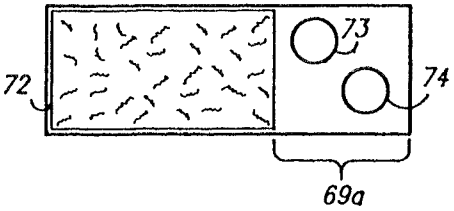
FIG. 15 is a top plan view of the top member of the container box of the organizer of FIG. 9.
Figure 14:
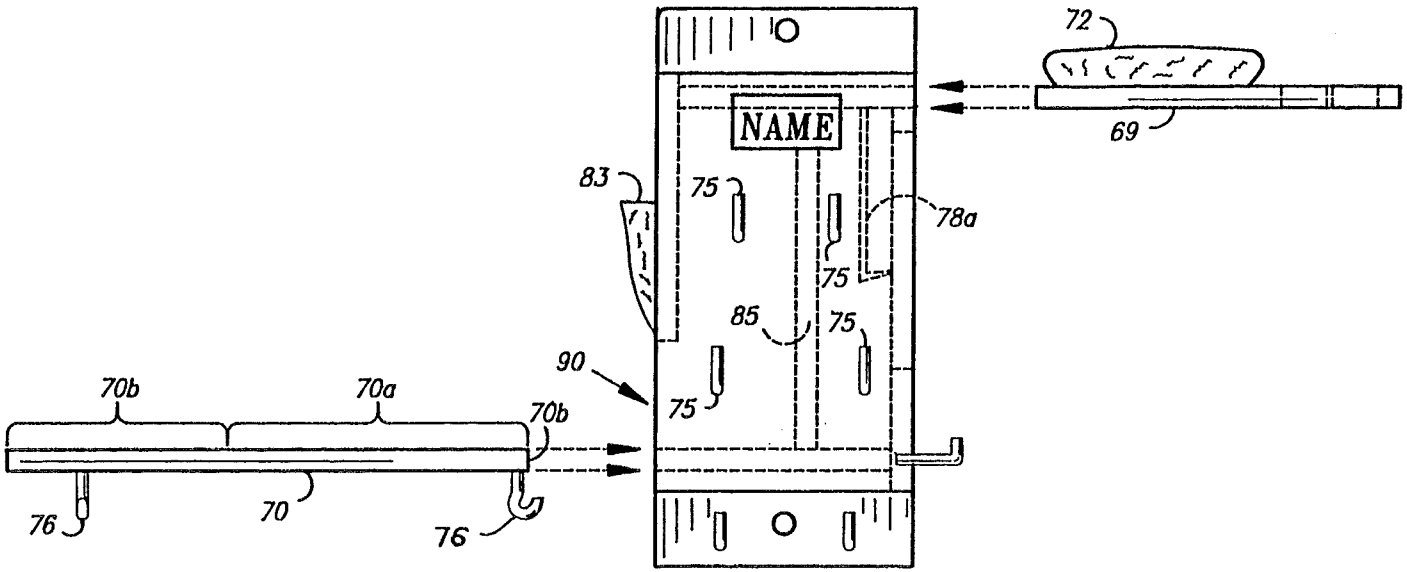
FIG. 14 is a front partially exploded, view of the organizer of FIG. 9 wherein the slidable top and bottom members of the container box of the organizer are removed therefrom.

A modified form of organizer designed for use by a tailor for the storage and retention of a tailor's accessories is shown in FIG. 9. It will be seen in FIG. 9 that the organizer 60, like the organizer 20, comprises a container box 61 having side walls 62, 63, a front wall 66, a back wall 68 and slidably mounted top and bottom members 69, 70 respectively. However, the side wall 62 is designed shorter than the side wall 63 and does not extend to the bottom member 70 for purposes to hereinafter described. The top member 69 is slidably received in a pair of elongate grooves 71 formed on the interior surfaces of the front and back wall members 66, 68 in similar manner to the grooves 31 in the organizer 20. For slidably accommodating the bottom member 70, a second pair of grooves 71*a* are formed on the inner surfaces of the members 66, 68 near their bottom edges in a manner similar to the grooves 38 in the organizer 20. A lock screw hook 64, similar to screw hook 36, is threaded through the wall 62 and is adapted to releaseably lock the top 69 when in its closed position.

Also, similar to organizer 20, the back wall 68 is longer than the front wall 66, being provided with a top extension 68*c* and bottom extension 68*d* which project beyond the top and bottom of the box 61. Extensions 68*c*, 68*d* are each provided with a hole 70, located along the centerline of the back wall 68, and of a size suitable for receiving a fastener nail or screw whereby the organizer 60 may be readily attached to a wall structure.

The top member 69 of the organizer 60 differs from the top member 29 of organizer 20 in that it is provided with an extension 69*a* which projects beyond the right side 63 of the box and serves as a handle which facilitates manipulation of the top 69 to the closed position as shown in FIG. 9 or to facilitate its removal from the box 61. A pair of holes 73, 74 are also provided through the extension 69*a* and are of a size adapted to receive a tailor's fingers therethrough to permit a better grasp of the handle.

Mounted atop the slidable top member 69 is a pin cushion 72 which seats directly atop the container box 61 when the top member 69 is in its closed position. The pin cushion substantially covers the top of the box 61 and is adapted to receive a very large number of a tailor's pins. It is bonded to the member 69 by a suitable adhesive although the pin cushion might be detachably mounted on the top member 69 by other means such as by provision of VELCRO type fastener patches, one of which is bonded to member 69 and the other of which is bonded to the underside of the pin cushion.

The bottom member 70 of the container box 61 comprises a first portion 70*a* which extends from its right edge 70*b* and completely closes the bottom of the container box when its right edge 70*b* is disposed co-planar with the outer surface of the wall member 63. The bottom 70 also comprises an extension 70*c* which projects beyond the side wall member 62 when it is in its closed position. The extension 70*c* of bottom member 70 is of the same length as the handle extension 69*a* of the top member 69.

The organizer 60 is also provided with screw hooks 75, the threaded shanks of which are screwed into the front exterior of the front wall 66 of box 61 with their hook portions oriented upwardly. As seen in FIG. 9 there is an upper pair and a lower pair of the screws 75, the members of each pair being symmetrically located on opposite sides of the vertical centerline of the front member 66. The screw hooks 75 are also of the type wherein the hook portion is formed by a right-angle bend with the shank portion. A similar pair of screw hooks 75*a* are fixed to bottom extension 68*d*.

Also affixed to the underside of the bottom member 70 are a pair of screw hooks 76 located at opposite ends of the member 70. The screw hooks 76 include curved hook portions which are oriented so as to accommodate the suspension of a tailor's accessory therefrom.

Another feature of the organizer 60 is the provision of an elongate vertically oriented slot 77 in the side wall member 63. The slot 77 is located along the vertical centerline of the side wall 63 and is of a length which is sufficient to accommodate the up-and-down movement of a tailor's chalk when placed therein.

The organizer 60 is also provided with a chalk sharpener 78 which is mounted inside the box 61. The sharpener 78 includes a body portion 78*a* in the form of a metallic sheet which is mounted with opposite edge portions seated in vertical grooves 79 formed in the inner surfaces of the front wall and back wall members of the box 61. The sharpener includes a blade portion 78*b* which projects from the body portion 78*a* and has a blade edge 80 which extends into the elongate slot 77. The blade edge is oriented such that a tailor's chalk can be sharpened thereon by up-and-down movement of the chalk when in the slot 77 and in engagement with the blade edge.

To prevent the escape of chalk dust from the container box as produced by a chalk sharpening action, a chalk dust retention means 82 is provided. The retention means 82 is a lining of elastic material which is bonded to the inner edges of the elongate slot 77. As a chalk is withdrawn from the slot 77, the elastic brushes the sides of the chalk and collects the chalk dust therefrom thereby preventing its escape into the surrounding air.

In addition, a pocket 83 for accessories is fitted to the exterior of the side wall 62. The pocket is formed from two sheets of flexible material, preferably leather, in a manner similar to the pockets 55 of the organizer 20, with one of the sheets bonded flush to the side wall 62.

It will thus be seen that the organizer 60 is a very useful device for a tailor. The size of the container box is such that it can be used for the storage of tailor's chalk. Since the container box 61 has a sharpener 78 mounted therein, it is desirable that a vertical divider wall 85 be installed in the box between the side wall 62 and the sharpener 78 to provide an isolated chalk compartment 88. The chalk is loaded into the compartment 88 through the top of the box 61 when the top member 69 is retracted to the open position. It is removed from the box as needed, through an opening 90 in the side of the box formed by the short side wall 62 which does not reach to the bottom 70. As seen in FIG. 9, it is apparent that the organizer 60 can be used for locating such items as trimming scissors, seam rippers, measuring tapes, rulers, a shoe horn, pins and needles and various other items that a tailor employs in his profession.

Figure 16:
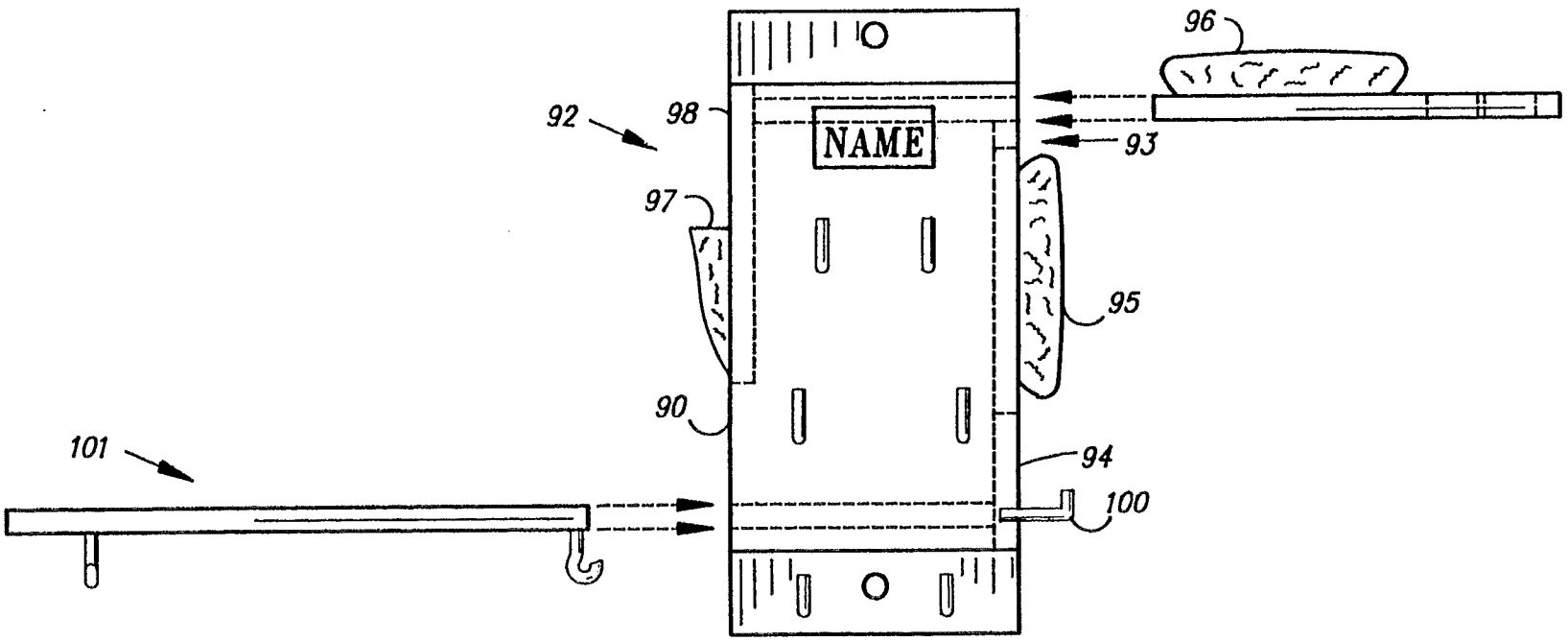
FIG. 16 is a front exploded view of another modification of the organizer of the invention.

For tailors who do not desire or do not have need for a chalk sharpener, a modified version of the tailor's organizer is shown in FIG. 16 by the organizer 92. The organizer 92 is similar to the organizer 60 but does not have a sharpener mounted in its container box 93 or a slot in its right side wall 94. Instead a pin cushion 95 is bonded by a suitable adhesive to the wall 94. The organizer 92 includes a second pin cushion 96 mounted to the top 99 of the container box and a pocket 97 secured to the left wall 98 in similar fashion to the pin cushion 72 and pocket 83 of the organizer 60. A hook screw 100 through wall 93 releaseably retains the bottom member 101.

It is to be understood that the foregoing description of the invention has been presented for purposes of illustration and explanation and is not intended to limit the invention to the precise form disclosed. For example, the materials used in fabrication may be different than herein disclosed and the container box might have other than rectangular wall members. Also, means might be used other than screw hooks through the walls for releasably locking the top member and the bottom member in closed position, such as, for example, cam locking devices, latches and the like. It is to be appreciated therefore that various structural changes may be made by those skilled in the art without departing from the invention.

What is claimed is:

1. An organizer for personal accessories which is mountable on a wall structure and is adapted for the storage and suspension of personal accessories therefrom, said organizer comprising:

a container box having a pair of side wall members, front wall and back wall members in substantially parallel relation to one another, and top and bottom members;

means for mounting said top member for sliding movement on said container box whereby said top member is moveable between a first position which closes the top of the container box and a second position which opens the top of said container box;

means for mounting said bottom member for sliding movement on said container box whereby said bottom member is moveable between a first position which closes the bottom of the container box and a second position which opens the bottom of said container box;

a first screw hook having an elongate threaded shank and a hook portion extending from said shank, said first screw hook being screwed into one of said container side wall members with its hook portion disposed outside said box and adapted to be screwed with axial movement of its shank into an end edge of the top member when said top member is in its closed position to thereby retain the top member in its closed position;

first handle means provided on said top member to facilitate its actuation in sliding movement;

a second screw hook substantially identical to said first screw hook and being fastened to said box with its hook portion disposed outside the box and its shank threaded into the exterior surface of the front wall member and extending through the bottom portion of said front wall member which slidingly accommodates the slidable bottom member of the container box, said second screw hook being adapted to be screwed with axial movement of its shank into the front edge of the bottom member to thereby retain and lock the bottom member when in its box closing position, and to be oriented such that its hook portion is adapted to serve as a hook from which to suspend a personal accessory, said second screw hook being retractable from connection with said bottom member to release said bottom member;

second handle means provided on said bottom member to facilitate its actuation in sliding movement;

a first plurality of screw hooks fastened in uniformly spaced array by screwing into the front edge of an end portion of the bottom member which receives an additional screw hook, each of said plurality of screw hooks being substantially identical to said first screw hook and oriented with its hook portion adapted to serve as a hook from which a personal accessary may be suspended;

a second plurality of screw hooks fastened to said bottom member in uniformly spaced array, each of said second plurality of screw hooks having a threaded shank and a hook portion and being threaded into the underside of the end portion of said bottom member which receives said first plurality of screw hooks to thereby provide a series of uniformly spaced hooks from which to suspend personal accessories;

pocket means of flexible material fastened to at least one of the wall members of the container box to provide a pocket which is open upward and adapted to receive miscellaneous personal items and accessories, said back wall member of the container box having a top extension and a bottom extension wherein the top extension extends above said side wall members and front wall member of the container box and the bottom extension extends below said side wall members and said front wall member, said bottom extension having a pair of screw hooks threadedly fastened thereto with their hook portions disposed towards the front of the container box and oriented to provide hooks from which to suspend personal accessories thereon; and means provided in said back wall member for attaching the organizer to a wall structure.

2. An organizer for personal accessories as set forth in claim 1 wherein said handle means provided on said top member is a first additional screw hook having its shank threaded into the other end of said top member to thereby serve as a handle to facilitate sliding movement of said top member between its open and closed positions and adaptable to be oriented such that its hook portion can serve as a hook from which to suspend a personal accessary thereon; and a second additional screw hook substantially identical to said first screw hook, said second additional screw hook having its shank threaded into an end edge of the bottom member to thereby serve as a handle to facilitate the sliding movement and positioning of the bottom member in said second pair of grooves and being oriented such that its hook portion can serve as a hook from which to suspend a personal accessary thereon.

3. An organizer for personal accessories which is mountable on a wall and is adapted for the storage and suspension of personal accessories therefrom, said organizer comprising:

a container box having side wall members, front wall and back wall members, and top and bottom members which are removably mounted thereon, said front and back members each having inner and outer surfaces and a first elongate groove formed on its inner surface near the top thereof to thereby provide a first pair of grooves adapted to receive opposite edge portions of the top member which is slidably mounted therein for movement between a first position which closes the top of the container box and a second position which opens the top of the container box, said front and back members each having a second elongate groove formed on its inner surface near the bottom thereof to thereby provide a second pair of grooves which are adapted to receive opposite edge portions of the bottom member which is slidably and removeably mounted therein for movement between a first portion which closes the bottom of the container box and a second position wherein the bottom member is received from said box;

said top and bottom members each having a planar top surface, a front edge, a rear edge and end edges, and said bottom member being of a length which exceeds the width dimension of the container box between said side wall members and including a central portion and end portions adjoining therewith, said central portion being of a size and configuration suitable to close the bottom of the container box when positioned beneath the container side wall members and extending therebetween, each of said end portions having a depression formed in the top surface thereof to provide a scoop tray of relatively shallow depth which is suitable as a tray for miscellaneous pocket articles;

a first screw hook having an elongate threaded shank and a hook portion extending from one end of said shank, said first screw hook being screwed into one of said container side wall members with its hook portion disposed exteriorly of said box, and adapted to be screwed with axial movement of its shank through said side wall member and into an end edge of the top member when said top member is in its closed position to thereby retain the top member in its closed position and also to be oriented such that its hook portion is adapted to serve as a hook from which to suspend a personal accessory, said first screw hook being unscrewable from connection with said top member to release said top member;

a second screw hook substantially identical to said first screw hook, said second screw hook having its shank threaded into the other end edge of said top member to thereby serve as a handle to facilitate sliding movement of said top member between its open and closed positions and adaptable to be oriented such that its hook portion can serve as a hook from which to suspend a personal accessary thereon;

a third screw hook substantially identical to said first screw hook and having its hook portion disposed exteriorly of said box and its shank threaded into the exterior surface of the front member and extending through the groove near the bottom end of said front wall member which slidingly accommodates said bottom member of the container box, said third screw hook being adapted to be screwed with axial movement of its shank into the front edge of the bottom member to thereby retain and lock the bottom member when in its box closing position, and to be oriented such that its hook portion is adapted to serve as a hook from which to suspend a personal accessory, said third screw hook being adapted to be unscrewed from connection with said bottom member to release said bottom member;

a fourth screw hook substantially identical to said first screw hook, said fourth screw hook having its shank threaded into an end edge of the bottom member to thereby serve as a handle to facilitate the sliding movement and positioning of the bottom member in said second pair of grooves and being oriented such that its hook portion can serve as a hook from which to suspend a personal accessary thereon;

a first plurality of screw hooks fastened in uniformly spaced array by screwing into a front edge of an end portion of the bottom member which receives said fourth screw hook, each of said plurality of screw hooks being substantially identical to said first screw hook and oriented with its hook portion adapted to serve as a hook from which a personal accessary may be suspended;

a second plurality of screw hooks fastened to said bottom member in uniformly spaced array, each of said second plurality of screw hooks having a threaded shank and a hook portion and being threaded into the underside of that end portion of said bottom wall member which receives said first plurality of screw hooks to thereby provide a series of uniformly spaced hooks from which to suspend personal accessories;

pocket means of flexible material fastened to at least one of the side wall members and front wall member of the container box to provide a pocket which is open upward and adapted to receive miscellaneous personal items and accessories; and means provided in said back wall member for attaching the organizer to a wall structure.

4. An organizer for personal accessories as set forth in claim 3 wherein said back wall member of the container box has a top extension and a bottom extension with the top extension extending above said side wall members and front wall member of the container box and the bottom extension extending below said side wall members and said front wall member, said bottom extension having a pair of screw hooks threadedly fastened thereto with their hook portions disposed towards the front of the container box and adapted to be oriented so as to provide hooks from which to suspend personal accessories thereon.

5. An organizer for accessories which is mountable on a wall and adapted for the storage and retention of a tailor's accessories, said organizer comprising:

a container box having a pair of side wall members, front wall and back wall members in substantially parallel relation to one another, and top and bottom members, said top member having a length which exceeds the distance between said side members of the box and provides a top member extension;

means for mounting said top member for sliding movement on said container box whereby said top member is moveable between a first position which closes the top of the container box and a second position which opens the top of said container box;

means for mounting said bottom member for sliding movement on said container box whereby said bottom member is moveable between a first position which closes the bottom of the container box and a second position which opens the bottom of said container box, said bottom member having a length which exceeds the distance between said side wall members of the box and provides a bottom member extension;

one of said side wall members of said container box having an elongate slot formed therein which is of a length sufficient to accommodate back-and-forth movement of a tailor's chalk when placed in said slot;

a chalk sharpener blade mounted in said container box and having a blade edge which extends into said elongate slot whereby a tailor's chalk can be sharpened thereon by back-and-forth movement of the chalk when placed in said slot and engaging the blade edge;

chalk dust retention means fixed to the opposing edges of said elongate slot for removing and retaining chalk dust from a tailor's chalk as the chalk is withdrawn from said elongate slot; and a plurality of screw hooks, each having a threaded shank and a hook portion, and said screw hooks being fixed in selectively spaced orientation on the exterior of said box with their hook portions oriented such that a variety of tailor's accessories may be suspended therefrom.

6. An organizer as set forth in claim 5 wherein said top member extension has at least one opening therethrough which provides a finger hole for grasping said top member and effecting sliding movement thereof.

7. An organizer for accessories as set forth in claim 5 wherein said top and bottom member extensions are substantially equal in length and extend from opposite sides of the container box.

8. An organizer for accessories as set forth in claim 5 wherein the elongate slot in the side wall member is in a substantially vertical orientation.

9. An organizer for accessories as set forth in claim 5 further including:

a first additional screw hook having an elongate threaded shank and a hook portion extending from said shank, said first additional screw hook being screwed into one of said container side wall members with its hook portion outside said box and adapted to be screwed with axial movement of its shank into an end edge of the top member when the top member is in its closed position to thereby retain the top member in its closed position, said first additional screw hook being unscrewable to release said top member; and a second additional screw hook being an elongate threaded shank and a hook portion extending from its shank, said second additional screw hook being screwed into said front wall member of said container box with its hook portion outside said box and adapted to be screwed with axial movement of its shank into an end edge of the bottom member when the bottom member is in its closed position to thereby retain the bottom member in its closed position, said second additional screw hook being unscrewable to release said member.

10. An organizer for accessories as set forth in claim 8 further including:

a pocket of flexible material fastened in open-upward orientation to the side wall member of the container box which is opposite the slotted side wall member, said pocket being adapted to receive miscellaneous tailor accessories therein.

11. An organizer for accessories as set forth in claim 9 further including:

a pin cushion releasably fastened on the outer surface of said top member on the portion thereof which does not include said top member extension.

12. An organizer for accessories as set forth in claim 11 further including:

means for releasably fastening said pin cushion to the outer surface of said top member, said releasable fastening means including a first patch of fabric-like fastener material bonded to the top surface of said top member and a second patch of fabric-like fastener material bonded to the surface of said pin cushion, one of said patches being provided with a plurality of flexible fastener hooks and the other of said patches being provided with a plurality of flexible fastener loops.

13. An organizer for accessories as set forth in claim 12 wherein one of said plurality of screw hooks is affixed to the underside of said bottom member extension with its hook portion in open-upward orientation suitable for suspending an accessory thereon.

14. An organizer for accessories as set forth in claim 5 wherein said container box is of a size sufficient to serve as a storage bin for a tailor's chalk.

15. An organizer for accessories as set forth in claim 12 further including:

means for fastening said container box to a wall.

16. An organizer for personal accessories which is mountable on a wall structure and is adapted for the storage and suspension of personal accessories therefrom, said organizer comprising:

a container box having a pair of side wall members, front wall and back wall members in substantially parallel relation to one another, and top and bottom members;

means for mounting said top member for sliding movement on said container box whereby said top member is moveable between a first position which closes the top of the container box and a second position which opens the top of said container box;

means for mounting said bottom member for sliding movement on said container box whereby said bottom member is moveable between a first position which closes the bottom of the container box and a second position which opens the bottom of said container box;

means mounted on said container box for releasably locking the top member when said top member is in its closed position;

first handle means provided on said top member to facilitate its actuation in sliding movement;

means mounted on said container box for releasably locking the bottom member when said bottom member is in its closed position;

a plurality of screw hooks, each having a threaded shank and a hook portion, and said screw hooks being fixed in selectively spaced orientation on the exterior of said box with their hook portions oriented such that a variety of accessories may be suspended therefrom;

pocket means of flexible material fastened to at least one of the wall members of the container box to provide a pocket which is open upward and adapted to receive miscellaneous personal items and accessories, said back wall member of the container box having a top extension and a bottom extension wherein the top extension extends above said side wall members and front wall member of the container box and the bottom extension extends below said side wall members and said front wall member, said bottom extension having a pair of screw hooks threadedly fastened thereto with their hook portions disposed towards the front of the container box and oriented to provide hooks from which to suspend personal accessories thereon; and means provided in said back wall member for attaching the organizer to a wall structure.

17. An organizer for personal accessories as set forth in claim 16 wherein said means for releasably locking the top member comprises:

a first screw hook having an elongate threaded shank and a hook portion extending from said shank, said first screw hook being screwed into one of said container side wall members with its hook portion disposed outside said box and adapted to be screwed with axial movement of its shank into an end edge of the top member when said top member is in its closed position to thereby retain the top member in its closed position.

18. An organizer for personal accessories as set forth in claim 16 wherein said means for releasably locking the bottom member comprises:

a second screw hook substantially identical to said first screw hook and being fastened to said box with its hook portion disposed outside the box and its shank threaded into the exterior surface of the front wall member and extending through the bottom portion of said front wall member which slidingly accommodates the slidable bottom member of the container box, said second screw hook being adapted to be screwed with axial movement of its shank into the front edge of the bottom member to thereby retain and lock the bottom member when in its box closing position and to be oriented such that its hook portion is adapted to serve as a hook from which to suspend a personal accessory, said second screw hook being retractable from connection with said bottom member to release said bottom member.

* * * * *